US006051824A

United States Patent [19]

Choi et al.

[11] Patent Number: 6,051,824

[45] Date of Patent: Apr. 18, 2000

[54] WET PREVENTION APPARATUS FOR SENSOR OF MICROWAVE OVEN

[75] Inventors: Moo Yeon Choi; Jung Doo Kim, both of Kyungsangnam-do, Rep. of Korea

[73] Assignee: LG Electronics Inc., Seoul, Rep. of Korea

[21] Appl. No.: 09/189,794

[22] Filed: Nov. 12, 1998

[30] Foreign Application Priority Data

Nov. 15, 1997 [KR] Rep. of Korea ..... 97-60248

[51] Int. Cl.[7] ..... H05B 6/50

[52] U.S. Cl. ..... 219/704; 219/707; 219/711; 219/757; 374/149

[58] Field of Search ..... 219/710, 711, 219/757, 702, 707, 704; 374/149

[56] References Cited

U.S. PATENT DOCUMENTS

| | | | |
|---|---|---|---|
| 4,191,876 | 3/1980 | Ohkubo et al. | 219/711 |
| 4,308,444 | 12/1981 | Takagi et al. | 219/757 |
| 5,693,248 | 12/1997 | Kim | 219/711 |

FOREIGN PATENT DOCUMENTS

| | | | |
|---|---|---|---|
| 0 72 803 A3 | 1/1997 | European Pat. Off. . | |
| 53-144044 | 12/1978 | Japan | 219/757 |
| 59-29926 | 2/1984 | Japan | 219/711 |
| 62-123228 | 6/1997 | Japan . | |

*Primary Examiner*—Philip H. Leung
*Attorney, Agent, or Firm*—Fleshner & Kim, LLP

[57] ABSTRACT

A wet prevention apparatus for a sensor of a microwave oven is disclosed, which prevents wet from occurring in a sensor for use in a microwave oven without a separate driving gear. In a microwave oven including a cooking chamber, and a machine chamber isolated from the cooking chamber by an isolation wall having a sensor hall, wherein a sensor case having a sensor therein and a fan are mounted in the machine chamber, the wet prevention apparatus for a sensor of the microwave oven includes an air receiving member for moving by air flow which occurs when driving the fan, and a blocking member linked to the operation of the air receiving member, for selectively blocking the sensor hole.

6 Claims, 5 Drawing Sheets

WET PREVENTION APPARATUS FOR SENSOR OF MICROWAVE OVEN

BACKGROUND OF THE INVENTION

1. Field of the Invention

The present invention relates to a wet prevention apparatus for a sensor of a microwave oven, and more particularly, to a wet prevention apparatus for a sensor of a microwave oven, which prevents wet from occurring in a sensor for use in a microwave oven without a separate driving gear.

2. Discussion of the Background Art

Generally, various sensors are used in a microwave oven to obtain various cooking information. As an example of the sensor, there is an infrared ray sensor for sensing a temperature inside a cooking chamber. The infrared ray sensor is mounted in a machine chamber, where various parts such as a magnetron and a fan are mounted, and senses a temperature inside the cooking chamber through a sensor hole formed at one sidewall of the cooking chamber. Vapor which occurs in the cooking chamber is entered into the machine chamber through the sensor hole, and wet occurs in the sensor due to the entered vapor. Accordingly, it is necessary to prevent wet from occurring in the sensor.

A background art wet prevention apparatus for a sensor of a microwave oven will be described with reference to FIGS. 1 and 2.

A microwave oven body 1 includes a cooking chamber 2 and a machine chamber 4. The cooking chamber 2 and the machine chamber 4 are isolated from each other by means of an isolation wall 1*a*. A sensor 12 which senses a temperature of the cooking chamber 2 is mounted in the machine chamber 4.

Describing the background art wet prevention apparatus for a sensor of a microwave oven in detail, a sensor bracket 5 is fixed to a predetermined position of the body 1. A sensor case 10 is rotatably mounted in the bracket 5. The sensor 12 is mounted within the sensor case 10.

A driving portion which rotates the sensor case 10 is mounted at one side of the sensor bracket 5. A step motor 13 is generally used as the driving portion. The step motor 13 transfers rotative force to the sensor case 10 through a power transmission means such as a gear 14.

The operation of the background art wet prevention apparatus for a sensor of a microwave oven will be described with reference to FIG. 2.

Since the sensor 12 must sense a temperature of the cooking chamber 12 during cooking, the sensor case 10 having the sensor 12 therein is arranged in such a manner that a filter 11 is placed toward a sensor hole 3 formed at the isolation wall 1*a*.

If cooking is completed, the step motor 13 is driven to rotate the sensor case 10 a predetermined angle, so that the filter 11 is not placed toward the sensor hole 3 to prevent wet from occurring in the filter 11 due to vapor entered from the cooking chamber 2 through the sensor hole 3.

However, the background art wet prevention apparatus for a sensor of a microwave oven has several problems.

First, since the background art wet prevention apparatus for a sensor has a structure which prevents wet from occurring by rotating the sensor case 10, a driving portion, i.e., a step motor 13 for rotating the sensor case 10, and the gear 14 are required. This results in complicated structure, increases the number of parts, and complicates assembly process. As a result, the manufacturing cost is also increased.

In addition, since the step motor 13 should be controlled depending on cooking course, a separate algorithm for controlling the step motor is required.

Finally, since the step motor 13, the gear 14 and the sensor case 10 are all driven, it is likely that the driving portion is wrong.

SUMMARY OF THE INVENTION

Accordingly, the present invention is directed to a wet prevention apparatus for a sensor of a microwave oven that substantially obviates one or more of the problems due to limitations and disadvantages of the background art.

An object of the present invention is to provide a wet prevention apparatus for a sensor of a microwave oven, which prevents wet from occurring in a sensor for use in a microwave oven without a separate driving gear.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, in a microwave oven including a cooking chamber, and a machine chamber isolated from the cooking chamber by an isolation wall having a sensor hole, wherein a sensor case having a sensor therein and a fan are mounted in the machine chamber, a wet prevention apparatus for a sensor of a microwave oven according to the present invention includes an air receiving member for moving by air flow which occurs when driving the fan, and a blocking member linked to the operation of the air receiving member, for selectively blocking the sensor hole.

The air receiving member has a plate shape and is approximately mounted in parallel with the fan, and the blocking member has a plate shape and is approximately mounted in parallel with the isolation wall.

The wet prevention apparatus is rotatably mounted in a predetermined position of a suction guide which guides air flow generated by the fan. The wet prevention apparatus may rotatably be mounted in the sensor case directly.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
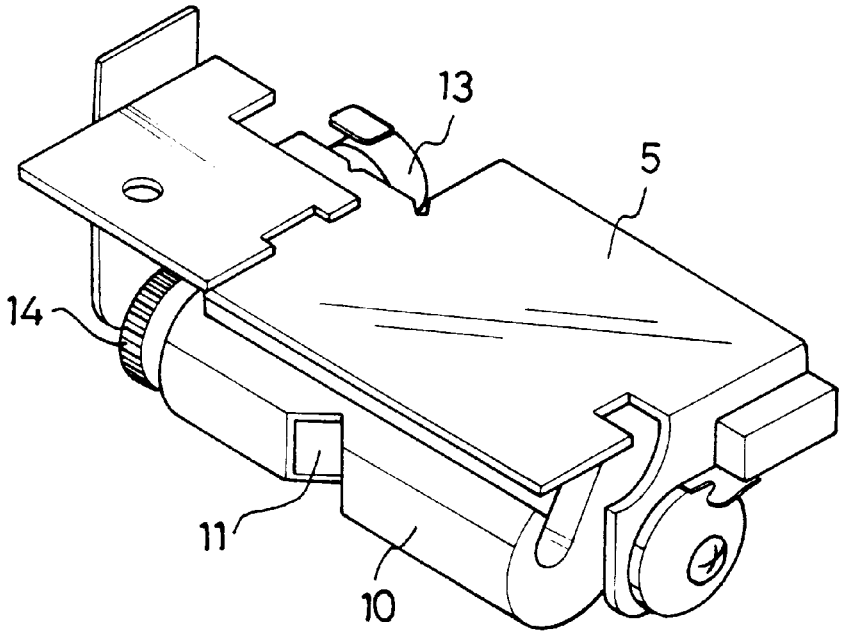
FIG. 1 Background Art
FIG. 1 is a perspective view illustrating a background art wet prevention apparatus for a sensor of a microwave oven.
Figure 2:
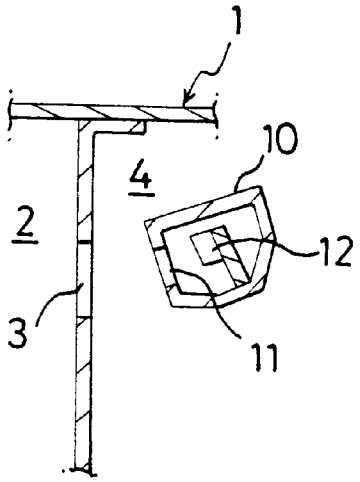
FIG. 2 Background Art
FIG. 2 is a sectional view illustrating the operation of a background art wet prevention apparatus for a sensor of a microwave oven.
Figure 3:
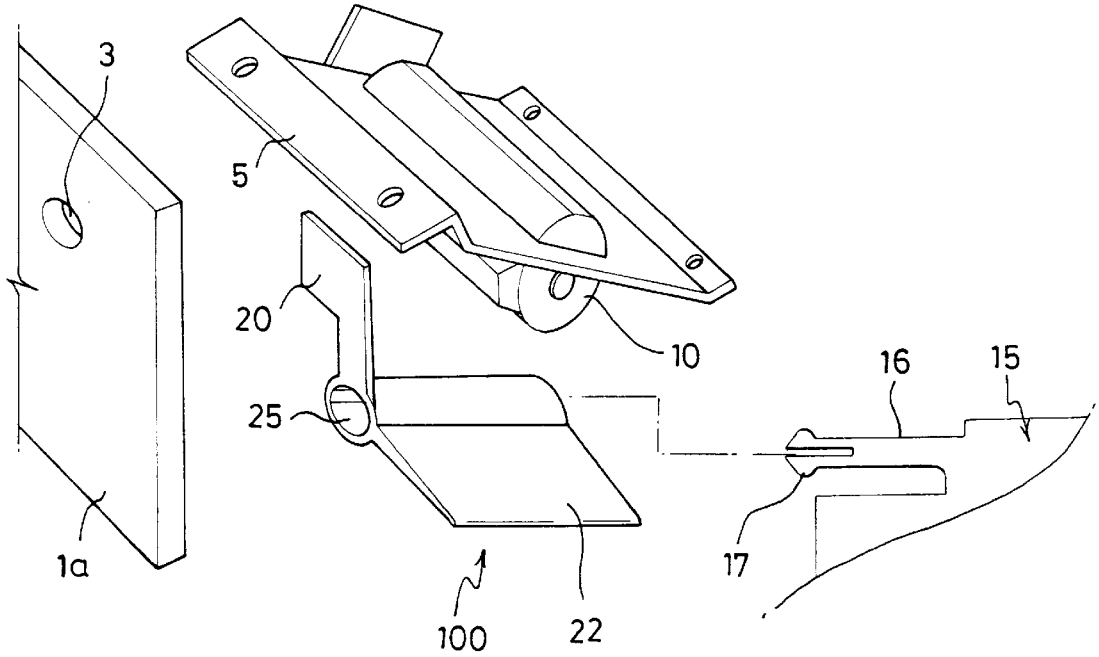
FIG. 3 is an exploded perspective view illustrating a wet prevention apparatus for a sensor of a microwave oven according to the first embodiment of the present invention.

FIG. 3 is an exploded perspective view illustrating a wet prevention apparatus for a sensor of a microwave oven according to the first embodiment of the present invention. The wet prevention apparatus for a sensor of a microwave oven according to the first embodiment of the present invention will now be described with reference to FIG. 3. The same elements as the background art have the same reference numerals as those of the background art and their description is omitted.

A sensor bracket 5 is fixed to a predetermined position of a microwave oven body. A sensor case 10 is mounted in the sensor bracket 5. A wet prevention apparatus 100 is rotatably mounted in a suction guide 15 which guides air flow generated by a fan.

The wet prevention apparatus 100 will be described below.

The wet prevention apparatus 100 includes an air receiving member 22 for moving by air flow generated by the fan, and a blocking member 20 linked to the operation of the air receiving member 22, for selectively blocking a sensor hole 3.

It is preferable that the air receiving member 22 has a plate shape in such a manner that an area which contacts with air is large. Also, it is preferable that the blocking member 20 has an area capable of blocking the sensor hole 3. It is more preferable that the blocking member 20 has a plate shape having a large area to facilitate blocking of the sensor hole 3.

The air receiving member 22 is mounted to allow its surface having a large area to be placed toward a fan 9. Thus, the air receiving member 22 can smoothly move by air generated by the fan 9. The blocking member 20 is mounted to allow its surface having a large area to be placed toward the sensor hole 3. Accordingly, the air receiving member 22 and the blocking member 20 are approximately orthogonal each other. The center of gravity of the wet prevention apparatus 100 is placed toward the air receiving member 22. Thus, the blocking member 20 is placed to block the sensor hole 3 by tare of the wet prevention apparatus 100 when the fan stops its operation. While the blocking member 20 rotates to open the sensor hole 3 when the fan is driven.

The construction of the aforementioned wet prevention apparatus 100 will be described below.

A hinge shaft 16 is formed at one side of the suction guide 15. A free end of the hinge shaft 16 is cut away, so that a projection 17 is formed up and down. A hollow portion 25 is formed between the air receiving member 22 and the blocking member 20. The hinge shaft 16 is rotatably inserted into the hollow portion 25.

After the hinge shaft 16 is inserted into the hollow portion 25, the projection 17 prevents the wet prevention apparatus 100 from being detached. At this time, the blocking member 20 should be placed between the sensor hole 3 and the sensor to selectively block the sensor hole 3 depending on the operation of the fan 9.

The operation of the aforementioned wet prevention apparatus 100 for a sensor of a microwave oven will be described with reference to FIGS. 4A and 4B.

Figure 4A:
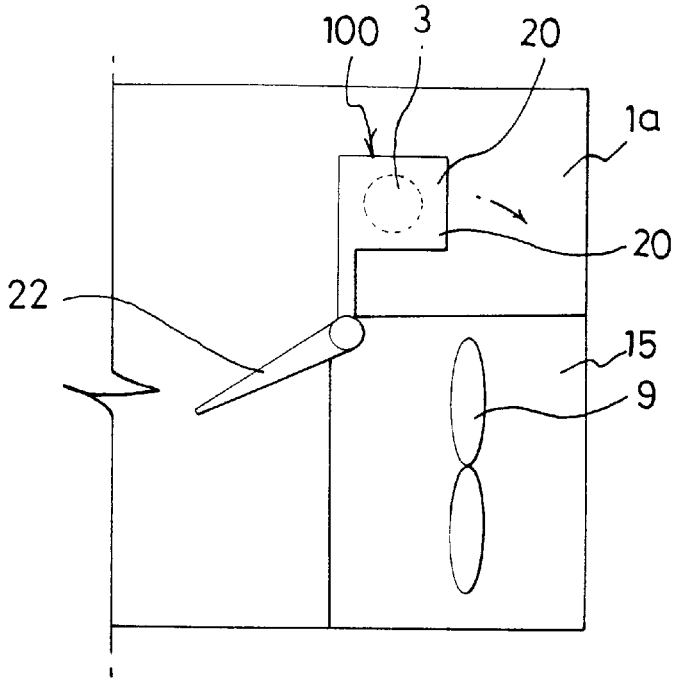
FIGS. 4A and 4B are side views of FIG. 3, illustrating the operation of a wet prevention apparatus for a sensor of a microwave oven according to the present invention.
Figure 4B:
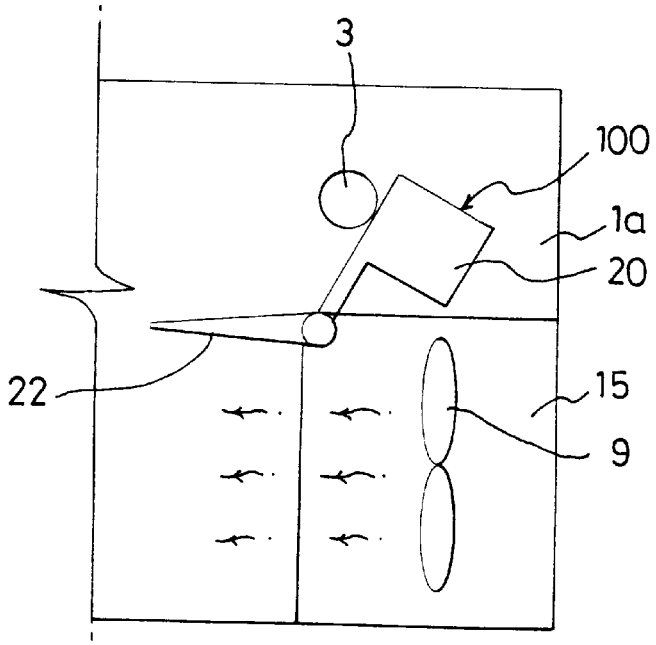

As shown in FIG. 4A, before the microwave oven is operated, the wet prevention apparatus 100 is placed in a predetermined position by tare. In other words, the wet prevention apparatus 100 is placed in such a manner that the blocking member 20 blocks the sensor hole 3.

If cooking starts, various parts in the machine chamber radiate and the fan 9 rotates to eliminate vapor of the cooking chamber. Then, as shown in FIG. 4B, the air receiving member 22 rotates clockwise on the drawing by air generated by rotation of the fan 9. The blocking member 20 linked to the operation of the air receiving member 22 also rotates and the sensor hole 3 is open. Accordingly, the sensor can sense a temperature inside the cooking chamber.

If cooking ends, rotation of the fan 9 stops. The air receiving member 22 does not rotate, either. Thus, the wet prevention apparatus 100 rotates counterclockwise by tare to block the sensor hole 3. Accordingly, it is possible to prevent vapor from occurring in the sensor through the sensor hole 3.

Figure 5:
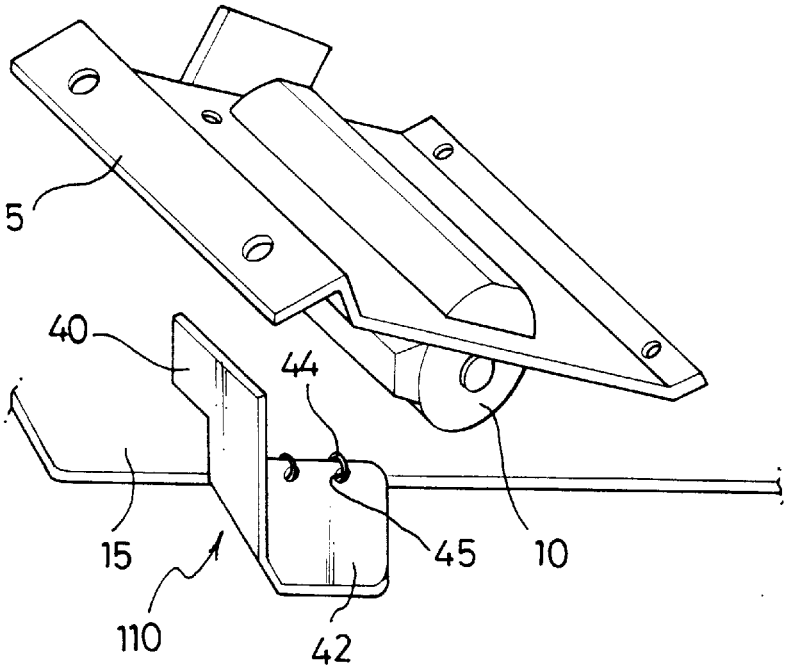
FIG. 5 is a perspective view illustrating a wet prevention apparatus for a sensor of a microwave oven according to the second embodiment of the present invention.

In this embodiment, while the hollow portion 25 is formed in the wet prevention apparatus 100 and the hinge shaft 16 which is inserted into the hollow portion 25 is formed in the suction guide 15, as shown in FIG. 5, a rotation ring 44 may be formed in the suction guide 15 and a hole 45 into which the rotation ring 44 is inserted may be formed in the wet prevention apparatus 100. In other words, the wet prevention apparatus 100 rotates around the rotation ring 44 to selectively block the sensor hole.

Figure 6:
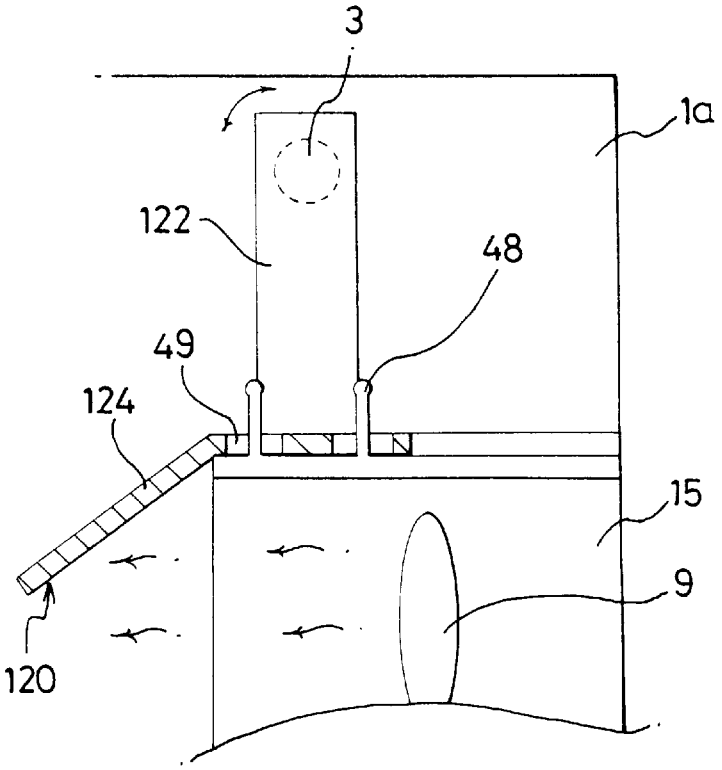
FIG. 6 is a side view illustrating a wet prevention apparatus for a sensor of a microwave oven according to the third embodiment of the present invention.

Furthermore, as shown in FIG. 6, a projection 48 may be formed in the suction guide 15 and a hole 49 into which the projection 48 is inserted may be formed in the wet prevention apparatus 100. The operation of the wet prevention apparatus 100 is the same as the aforementioned embodiment.

It is to be understood that various modifications and variations can be made in the respective members of the wet prevention apparatus according to the aforementioned embodiments of the present invention without departing from the spirit or scope of the invention. For example, the air receiving member 22 and the blocking member 20 may properly be modified in their shapes or assembly structure of the wet prevention apparatus 100 may properly be modified.

In the aforementioned embodiments, while the wet prevention apparatus is mounted in the suction guide 15, the wet prevention apparatus 100 may be mounted in any other proper position. In other words, the wet prevention apparatus 100 may be mounted in a predetermined position of the body in such a manner that the blocking member 20 is placed between the sensor hole 3 and the sensor if air flow does not occur in the machine chamber.

The fourth embodiment of the present invention which will be described below is a modified example of the aforementioned embodiments. The operation of the fourth embodiment is different from the aforementioned embodiments in that the wet prevention apparatus 100 is incorporated into the sensor case 10.

Figure 7:
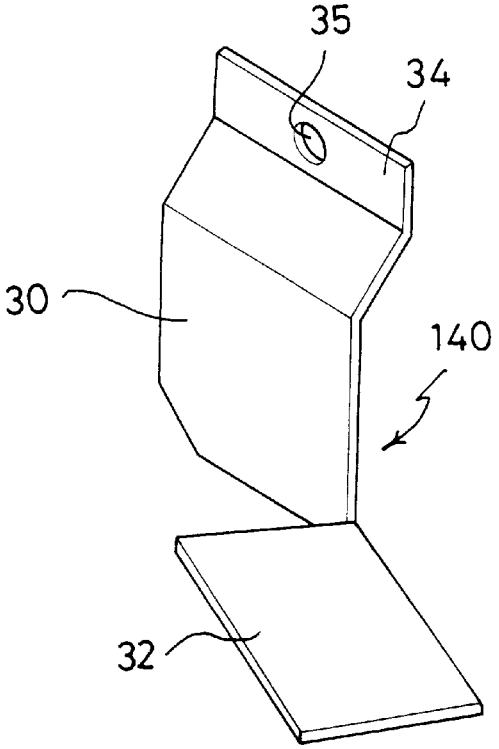
FIG. 7 is a perspective view illustrating a wet prevention apparatus for a sensor of a microwave oven according to the fourth embodiment of the present invention.
Figure 8:
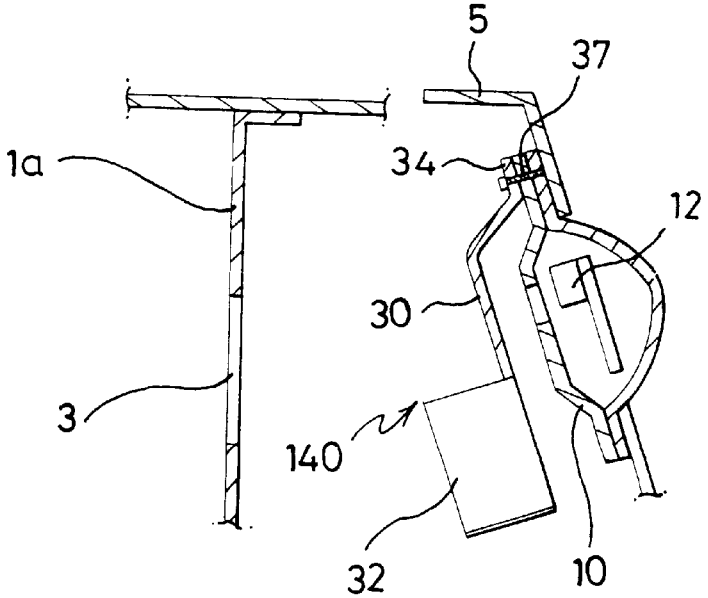
FIG. 8 is an assembly sectional view illustrating a wet prevention apparatus for a sensor of a microwave oven according to the fourth embodiment of the present invention.

The wet prevention apparatus 100 for a sensor of a microwave oven according to the fourth embodiment of the present invention will be described with reference to FIGS. 7 and 8.

A sensor case 10 having a sensor therein is incorporated into a sensor bracket 5. One end of the wet prevention apparatus 100 is rotatably incorporated into the sensor case 10. In other words, a rotation center member 34 having a hinge hole 35 therein is formed on a top of the blocking member 20. The rotation center member 34 is hinge-coupled to the sensor case 10 to rotate around a hinge shaft 37.

In this embodiment, the blocking member 20 is placed between the sensor hole 3 and the sensor, and the air receiving member 22 is placed to move depending on air flow generated by the fan 9.

In this embodiment, the wet prevention apparatus 100 rotates around the hinge shaft 37.

As aforementioned, the wet prevention apparatus for a sensor of a microwave oven according to the present invention has the following effects.

First, since the wet prevention apparatus is operated using air flow generated by rotation of the fan for use in the microwave oven, the structure of the wet prevention apparatus is simple and the manufacturing cost is reduced. In addition, unlike the background art, since the driving portion is not wrong, life-span of the microwave oven is extended and energy is also saved. Further, since a control algorithm for controlling the control means is not required, a control algorithm for use in the microwave oven becomes simple.

It will be apparent to those skilled in the art that various modifications and variations can be made in the wet prevention apparatus for a sensor of a microwave oven according to the present invention without departing from the spirit or scope of the invention. Thus, it is intended that the present invention covers the modifications and variations of the invention provided they come within the scope of the appended claims and their equivalents.

What is claimed is:

1. In a microwave oven comprising a cooking chamber, and a machine chamber isolated from the cooking chamber by an isolation wall having a sensor hole, the machine chamber including a sensor case having a sensor therein for sensing a condition in the cooking chamber and a fan, a wet prevention apparatus for the sensor of the microwave oven being located in the machine chamber comprising:

an air receiving member for moving by air flow which occurs when driving the fan; and a blocking member rigidly linked to the air receiving member, for selectively blocking the sensor hole when the air receiving member is moved by the air flow, wherein the blocking member and the air receiving member are different members.

2. The wet prevention apparatus as claimed in claim 1, wherein the air receiving member has a plate shape and is mounted substantially parallel to the fan, and the blocking member has a plate shape and is mounted substantially parallel to the isolation wall.

3. The wet prevention apparatus as claimed in claim 2, wherein the air receiving member is pivotably mounted to a suction guide which guides air flow generated by the fan.

4. The wet prevention apparatus as claimed in claim 3, wherein a hinge shaft is formed at one side of the suction guide and a hollow portion into which the hinge shaft is pivotably inserted is formed between the air receiving member and the blocking member.

5. The wet prevention apparatus as claimed in claim 3, wherein a projection is formed in the suction guide and a hole into which the projection is inserted is formed between the air receiving member and the blocking member.

6. The wet prevention apparatus as claimed in claim 2, wherein one end of the blocking member further comprises a hinge that is pivotably coupled to the sensor case.

* * * * *